US010184196B2

(12) United States Patent
Terai et al.

(10) Patent No.: US 10,184,196 B2
(45) Date of Patent: Jan. 22, 2019

(54) METHOD FOR KNITTING KNITTED FABRIC

(71) Applicant: SHIMA SEIKI MFG., LTD., Wakayama (JP)

(72) Inventors: Kenta Terai, Wakayama (JP); Yoshinori Shimasaki, Wakayama (JP)

(73) Assignee: Shima Seiki Mfg., Ltd., Wakayama-shi, Wakayama (JP)

( * ) Notice: Subject to any disclaimer, the term of this patent is extended or adjusted under 35 U.S.C. 154(b) by 127 days.

(21) Appl. No.: 15/518,551

(22) PCT Filed: Aug. 25, 2015

(86) PCT No.: PCT/JP2015/073838
§ 371 (c)(1),
(2) Date: Apr. 12, 2017

(87) PCT Pub. No.: WO2016/059879
PCT Pub. Date: Apr. 21, 2016

(65) Prior Publication Data

US 2017/0283996 A1 Oct. 5, 2017

(30) Foreign Application Priority Data

Oct. 17, 2014 (JP) ..... 2014-213029

(51) Int. Cl.
*D04B 7/28* (2006.01)
*D04B 1/22* (2006.01)
(Continued)

(52) U.S. Cl.
CPC ..... *D04B 7/28* (2013.01); *D04B 1/126* (2013.01); *D04B 1/22* (2013.01); *D04B 7/04* (2013.01);
(Continued)

(58) Field of Classification Search
CPC . D04B 1/10; D04B 1/102; D04B 1/22; D04B 1/24; D04B 1/126; D04B 7/04; D04B 7/24; D04B 7/28; D04B 7/32
See application file for complete search history.

(56) References Cited

U.S. PATENT DOCUMENTS 7,738,991 B2 * 6/2010 Klumpp ..... D04B 1/26 66/185
9,551,096 B2 * 1/2017 Nishino ..... D04B 1/26
(Continued)

FOREIGN PATENT DOCUMENTS

JP 2008-303489 A 12/2008
JP 2013-19069 A 1/2013
(Continued)

OTHER PUBLICATIONS

International Search Report cited in PCT/JP2015/073838 dated Nov. 17, 2015, 2 pages.

*Primary Examiner* — Danny Worrell
(74) *Attorney, Agent, or Firm* — Rothwell, Figg, Ernst & Manbeck, P.C.

(57) ABSTRACT

There is provided a method for knitting a knitted fabric capable of forming a decoration unit of a novel shape using a flat knitting machine. A decoration unit (2) is formed on a surface of a base knitted fabric portion (1), the decoration unit (2) being configured by a lower edge (2D) extending in a knitting width direction of the base knitted fabric portion (1), a left edge (2L) extending in a direction intersecting the knitting width direction from a left end of the lower edge (2D), and a right edge (2R) extending in a direction intersecting the knitting width direction from a right end of the lower edge (2D). The lower edge (2D) is configured by a cross-over yarn extending in the knitting width direction of the base knitted fabric portion (1). The left edge (2L) and the right edge (2R) are configured by stitches stretched in a
(Continued)

direction intersecting the knitting width direction. The cross-over yarn and the stitches are knitted all at once.

9 Claims, 6 Drawing Sheets

(51) Int. Cl.
*D04B 7/04* (2006.01)
*D04B 7/32* (2006.01)
*D04B 1/12* (2006.01)

(52) U.S. Cl.
CPC ..... *D04B 7/32* (2013.01); *D10B 2501/043* (2013.01)

(56) References Cited

U.S. PATENT DOCUMENTS

2015/0107307 A1* 4/2015 Kosui ..... D04B 1/22 66/177
2016/0128428 A1* 5/2016 Ikenaka ..... D04B 1/22 36/45
2016/0143394 A1* 5/2016 Ikenaka ..... D04B 1/106 66/170
2016/0198797 A1* 7/2016 Ikenaka ..... D04B 1/108 36/45

FOREIGN PATENT DOCUMENTS

JP 2014-88645 A 5/2014
JP 2015-74836 A 4/2015
WO 2014129068 A 8/2014

* cited by examiner

METHOD FOR KNITTING KNITTED FABRIC

CROSS REFERENCE TO RELATED APPLICATION

This application is a 35 U.S.C. 371 National Phase Entry Application from PCT/JP2015/073838, filed Aug. 25, 2015, which claims the benefit of Japan Patent Application No. 2014-213029 filed on Oct. 17, 2014, the disclosure of which is incorporated herein in its entirety by reference.

TECHNICAL FIELD

The present invention relates to a method for knitting a knitted fabric capable of adding a decoration of a novel shape, as if formed through sewing, to a base knitted fabric portion configuring the knitted fabric.

BACKGROUND ART

A knitted fabric having various knitting patterns is knitted using a flat knitting machine. For example, Patent Document 1 discloses a method for knitting a knitted fabric of interweaving a knitting yarn (decoration knitting yarn), which is different from a base knitting yarn for knitting a base knitted fabric portion, in the base knitted fabric portion, which is a main body of the knitted fabric, and a knitted fabric knitted with such knitting method. The decoration knitting yarn is bridged between two points on a surface on a front side in the base knitted fabric portion to decorate the front surface of the knitted fabric.

Decorating the front surface of the knitted fabric by sewing has been conventionally carried out. Through the use of sewing, decoration patterns of various shapes, for example, a decoration pattern in which box-shaped decoration units are continuously connected, and the like can be formed in the knitted fabric.

PRIOR ART DOCUMENT

Patent Document

[Patent Document 1] Japanese Unexamined Patent Publication No. 2008-303489

DISCLOSURE OF THE INVENTION

Problems to be Solved by the Invention

Forming the decoration pattern by sewing takes a great deal of time since such formation of the decoration pattern is carried out independent from the knitting after the knitting of the base knitted fabric portion is carried out. In order to provide the knitted fabric with high productivity, the decoration pattern may be knitted by the flat knitting machine using the method for knitting the knitted fabric of Patent Document 1, and the like, but the shape of the decoration pattern that can be knitted with the method for knitting the knitted fabric of Patent Document 1 is limited. Thus, development of a method for knitting a knitted fabric of forming a decoration pattern of a novel shape in the base knitted fabric portion using the flat knitting machine is desired. The knitted fabric of a variety of designs can be provided to the consumer with high productivity if the method for knitting the knitted fabric capable of forming the decoration pattern of a novel shape is obtained.

The present invention has been made in view of the above-described circumstances, and an object of the present invention is to provide a method for knitting a knitted fabric capable of forming a decoration pattern of a novel shape using a flat knitting machine.

Means for Solving the Problems

An aspect of the present invention relates to a method for knitting a knitted fabric in which a base knitted fabric portion is knitted and a decoration knitting yarn different from a base knitting yarn for knitting the base knitted fabric portion is interweaved in the base knitted fabric portion, using a flat knitting machine including one needle bed and another needle bed disposed opposite to each other in a front-back direction, and a plurality of yarn feeders that feed a knitting yarn to knitting needles of the needle beds. In the method for knitting the knitted fabric of the present invention, a decoration unit is formed on a front surface of the base knitted fabric portion according to process α to process ε, the decoration unit being configured by a lower edge extending in a knitting width direction of the base knitted fabric portion, a left edge extending in a direction intersecting the knitting width direction from a left end of the lower edge, and a right edge extending in a direction intersecting the knitting width direction from a right end of the lower edge.

[Process α] Transferring some stitches of the base knitted fabric portion held on the one needle bed to the other needle bed and leaving at least a left side starting stitch, which is a starting point for forming the left edge, and a right side starting stitch, which is a starting point for forming the right edge, on the one needle bed as a preparation for forming the lower edge.

[Process β] Using the decoration knitting yarn to knit a left edge stitch continuing in a wale direction of the left side starting stitch and a right edge stitch continuing in a wale direction of the right side starting stitch, and form a pickup stitch on an empty needle between the left edge stitch and the right edge stitch.

[Process γ] Removing the pickup stitch from the knitting needle, and forming the lower edge configured by the decoration knitting yarn traversing a front side of the stitches (i.e., the one needle bed side of the relevant stitches) transferred to the other needle bed in the process α between the left edge stitch and the right edge stitch.

[Process δ] Increasing number of knitting courses of the base knitted fabric portion with the left edge stitch and the right edge stitch remained held on the one needle bed.

[Process ε] Overlapping and fixing the left edge stitch and the right edge stitch with the stitches of the base knitted fabric portion, and forming the left edge configured by the left edge stitch and the right edge configured by the right edge stitch.

According to one aspect of the method for knitting the knitted fabric of the present invention, in the process α, a plurality of the left side starting stitches and a plurality of the right side starting stitches may be remained on the one needle bed. When knitting a plurality of decoration units adjacently in the knitting width direction, the right side starting stitch for forming the decoration unit on the left side may also serve as the left side starting stitch for forming the decoration unit on the right side, as shown in a first embodiment to be described later. All the starting stitches may be separate stitches, of course, when knitting the plurality of decoration units adjacently in the knitting width direction.

According to one aspect of the method for knitting the knitted fabric of the present invention, an upper edge connecting an upper end of the left edge and an upper end of the right edge may be formed according to processes ζ, η.

[Process ζ] Transferring some stitches of the base knitted fabric portion held on the one needle bed to the other needle bed and leaving at least a left fixing stitch for fixing a left end of the upper edge and a right fixing stitch for fixing a right end of the upper edge on the one needle bed as a preparation for forming the upper edge after the process ε.

[Process η] Using the decoration knitting yarn to carry out tuck on the left fixing stitch and the right fixing stitch and carry out miss between the fixing stitches, and forming the upper edge traversing a front side of the stitches transferred to the other needle bed in the process ζ between the fixing stitches.

According to one aspect of the method for knitting the knitted fabric of the present invention, in the process δ, processes $\delta_1$ to $\delta_3$ may be carried out to form the base knitted fabric portion to a tube shape.

[Process $\delta_1$] Branching the base knitted fabric portion to a base front part knitted with the one needle bed and a base back part knitted with the other needle bed.

[Process $\delta_2$] Increasing number of courses of at least the base front part.

[Process $\delta_3$] Connecting the base front part and the base back part by knitting.

According to one aspect of the method for knitting the knitted fabric of the present invention, when the base knitted fabric portion is held on the one needle bed and the other needle bed, and the decoration unit is knitted from a state an empty needle is not provided within a knitting width of the base knitted fabric portion, an empty needle may be formed within the knitting width of the base knitted fabric portion by transfer before the process α.

Effects of the Invention

According to the method for knitting the knitted fabric of the present invention, a decoration unit of a novel shape configured by the lower edge lined in the knitting width direction of the base knitted fabric portion, and the left edge and the right edge extending in the direction intersecting the lower edge from both ends of the lower edge can be formed. A decoration pattern of various designs can be formed in the base knitted fabric portion in a seamless manner, as will be shown in the embodiments to be described later, by combining such decoration unit of basic shape.

According to the method for knitting the knitted fabric of forming a plurality of starting stitches, in the process α, a knitted fabric having a structure pattern in which a plurality of decoration units are lined in the knitting width direction of the base knitted fabric portion can be knitted.

According to the method for knitting the knitted fabric of the present invention of carrying out the processes ζ, η after the process ε, a box-shaped decoration unit including the upper edge for connecting the upper end of the right edge and the upper end of the left edge can be formed.

According to the method for knitting the knitted fabric of the present invention of carrying out the processes $\delta_1$ to $\delta_3$ in the process δ, a portion where the decoration unit is formed in the base knitted fabric portion can be formed to a tube shape having the knitting width direction as an axis. The portion formed to a tube shape is expanded compared to the other portions, so that the decoration unit formed at the portion formed to the tube shape can be emphasized.

According to the method for knitting the knitted fabric of the present invention of forming the empty needle within the knitting width of the base knitted fabric portion by transfer before the process α, the decoration unit can be formed even if the base knitted fabric portion is held on the front and back needle beds in a full gauge state.

MODE FOR CARRYING OUT THE INVENTION

Embodiments of a method for knitting a knitted fabric of the present invention will be hereinafter described based on the drawings. A knitting example using a two-bed flat knitting machine including a front needle bed (hereinafter referred to as FB) and a back needle bed (hereinafter referred to as BB) extending in a traverse direction and disposed opposite to each other in a front-back direction, and a yarn feeder that feeds a knitting yarn, the BB being rackable in the traverse direction and stitches being transferable, will be described. The flat knitting machine to be used is not, of course, limited to the two-bed flat knitting machine, and may be, for example, a four-bed flat knitting machine.

First Embodiment

<<Overall Configuration>>

Figure 1:
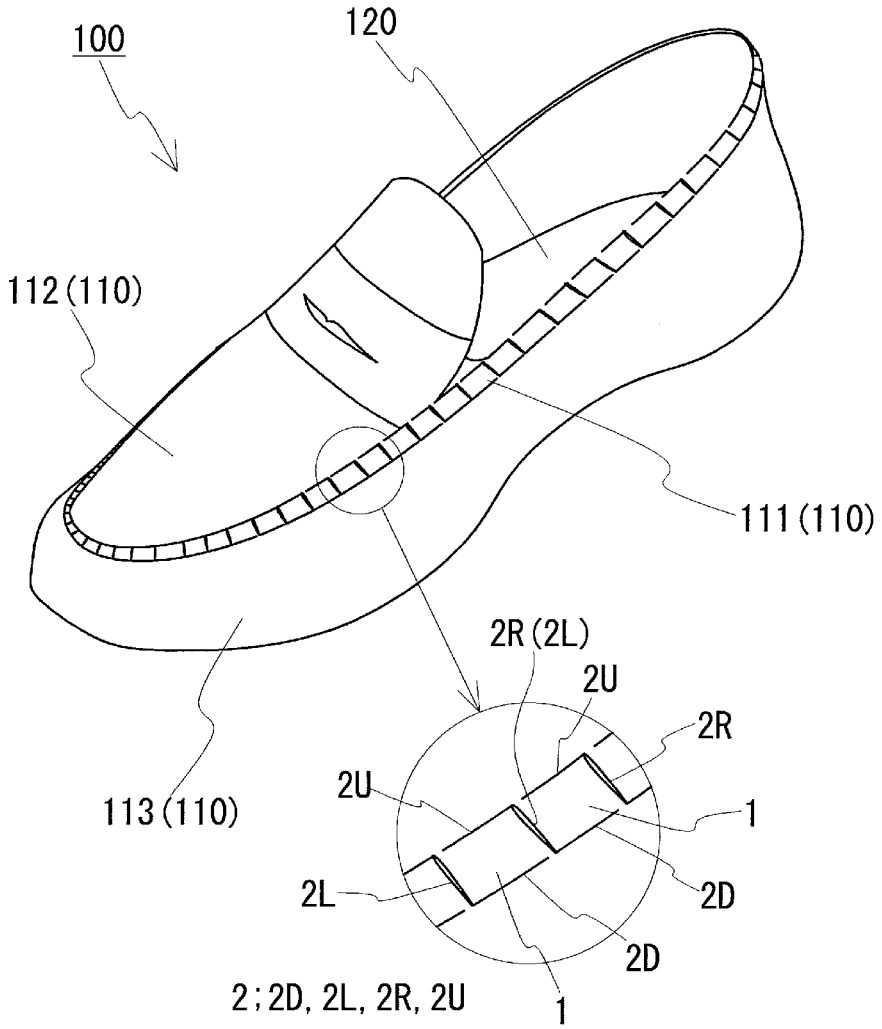
FIG. 1 is a schematic perspective view of a shoe upper of a first embodiment.

In the first embodiment, a method for knitting a knitted fabric of the present invention will be described using a shoe upper (knitted fabric) 100 shown in FIG. 1 by way of example. The shoe upper 100 is configured by an instep cover 110 that covers a portion on an instep side of a foot and a sole cover 120 that covers a sole, and is knitted in a seamless manner with the flat knitting machine. A decoration pattern 111 in which a plurality of box-shaped decoration units 2 is connected in a chain form is formed in the instep cover 110. The decoration pattern 111 appears as if formed by sewing, but is formed by knitting. For the sake of convenience, a portion on an upper side of the decoration pattern 111 of the instep cover 110 is referred to as an instep portion 112, and a portion on a lower side is referred to as a side portion 113.

The box-shaped decoration unit 2 is configured by a lower edge 2D, a left edge 2L, a right edge 2R, and an upper edge 2U. The lower edge 2D and the upper edge 2U are configured with a cross-over yarn extending in a knitting width direction of a base knitted fabric portion 1 (instep cover 110). The left edge 2L and the right edge 2R are configured with stitches stretched in a wale direction (direction intersecting the knitting width direction) of the base knitted fabric portion 1. The stitch configuring the left edge 2L is connected to a left end of the cross-over yarn configuring the lower edge 2D. The stitch configuring the right edge 2R appears as if not connected to a right end of the lower edge 2D. This is because one part of the right end of the lower edge 2D is arranged on a back side of the base knitted fabric portion 1 on purpose so that the decoration unit 2 has a sewn appearance, and actually, the stitch configuring the right edge 2R is connected to the cross-over yarn configuring the lower edge 2D on the back side of the base knitted fabric portion 1. In the present example, the right edge 2R of the decoration unit 2 on the left side also serves as the left edge 2L of the decoration unit 2 on the right side. The decoration unit 2 including these sides 2D, 2L, 2R, and 2U is knitted in a seamless manner using the flat knitting machine. Hereinafter, the method for knitting the knitted fabric of knitting the decoration unit 2 will be described.

<<Method for Knitting Shoe Upper>>

Figure 2:
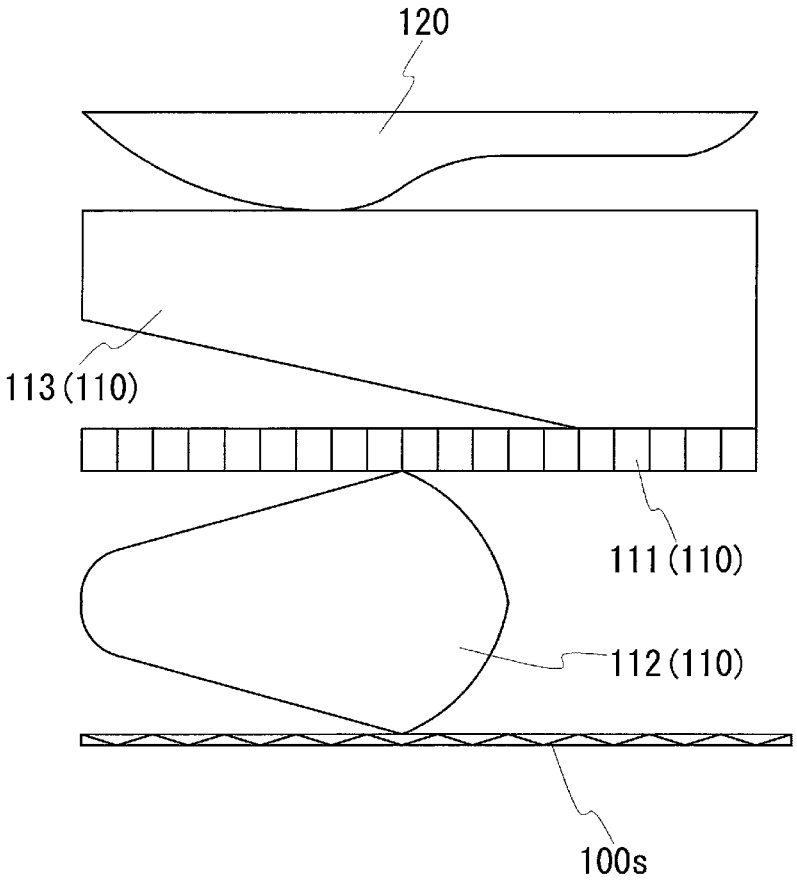
FIG. 2 is a knitting image view schematically showing a knitting procedure of the shoe upper of the first embodiment.

Before describing the knitting procedure of the decoration unit 2, an overall knitting procedure of the shoe upper 100 will be described first. The shoe upper 100 can be knitted, for example, according to a procedure shown in FIG. 2. In the procedure shown in FIG. 2, the shoe upper 100 is knitted sideways on the needle bed. In FIG. 2, only the right side portion is illustrated for a portion where the decoration pattern 111 is formed, the side portion 113, and the sole cover 120, and the left side portion thereof is arranged on the far side of the right side portion.

In FIG. 2, a set up section 100*s* is first formed on the FB and the BB. Following the set up section 100*s*, the instep portion 112 of the instep cover 110 is knitted using the FB (or BB). Next, after the portion where the decoration pattern 111 is formed is knitted using the FB and the BB, the side portion 113 of the instep cover 110 is knitted through the tubular knitting and the reciprocate knitting using the FB and the BB. The reciprocate knitting is carried out separately for the FB and the BB to knit the right side portion and the left side portion of the sole cover 120, and lastly, the right side portion and the left side portion are joined by knitting.

<<Knitting of Decoration Pattern as if Sewn>>

Figure 3:
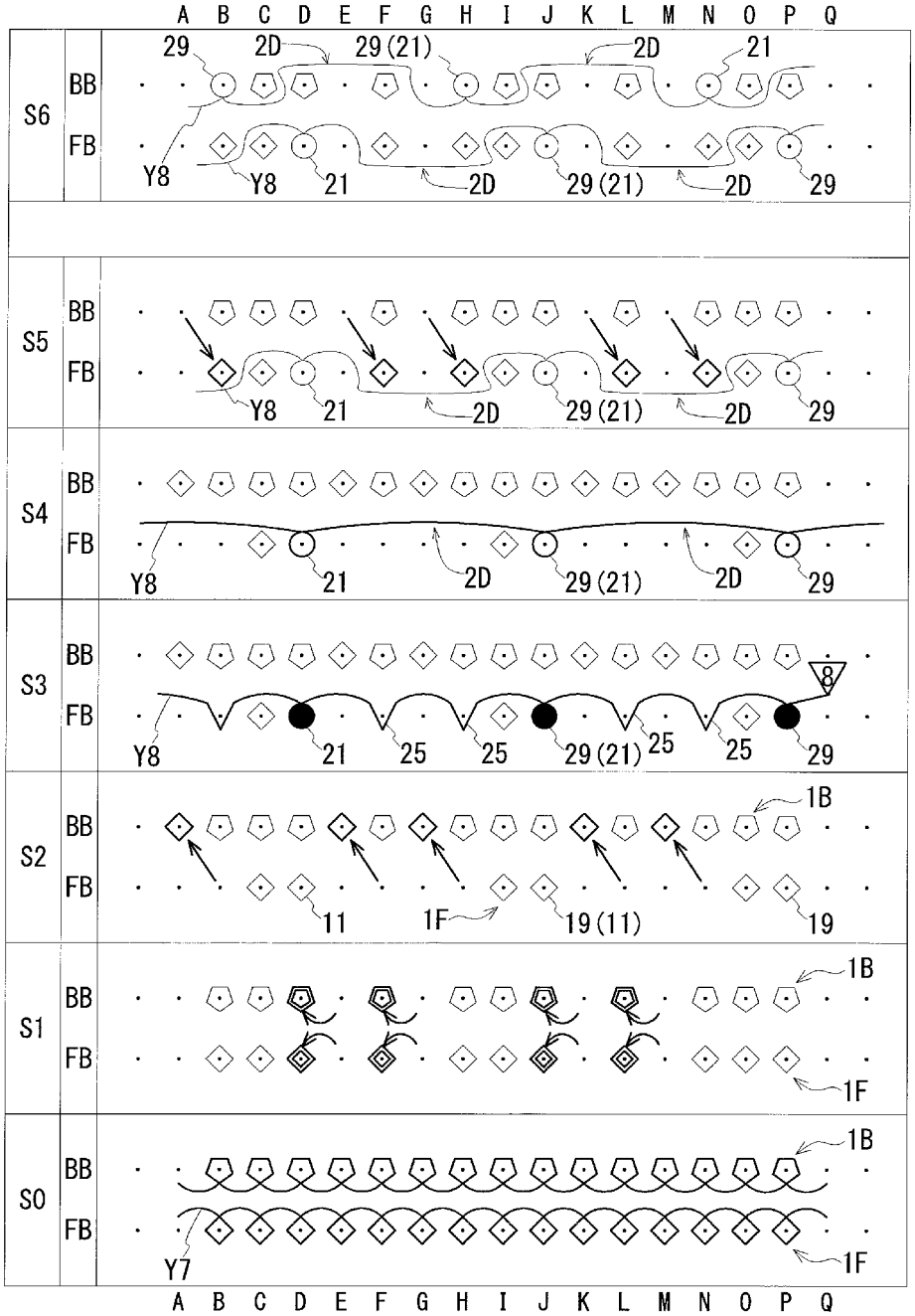
FIG. 3 is a knitting process diagram of a decoration unit arranged in the shoe upper of the first embodiment.
Figure 4:
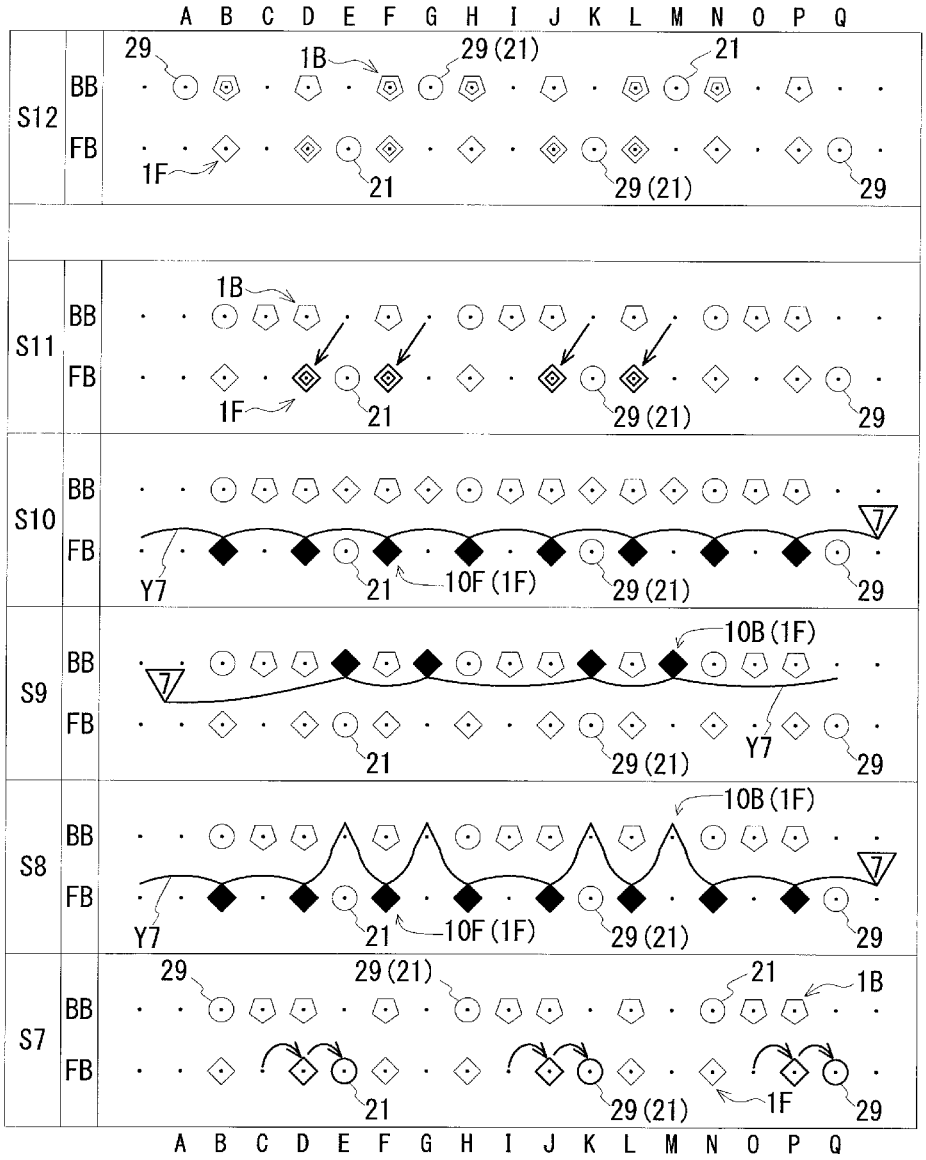
FIG. 4 is a knitting process diagram of the decoration unit following FIG. 3.
Figure 5:
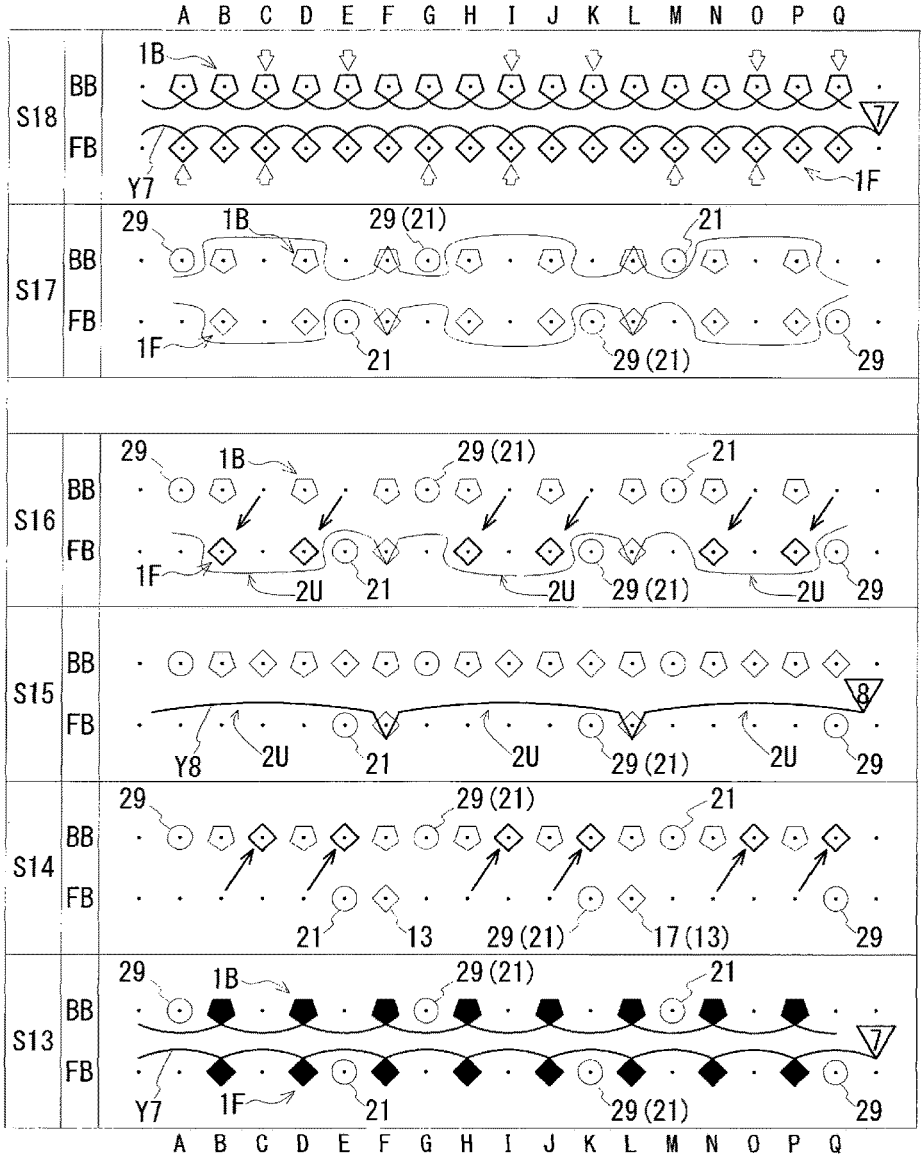
FIG. 5 is a knitting process diagram of the decoration unit following FIG. 4.

The portion where the decoration pattern 111 is formed shown in FIG. 2 can be knitted according to the knitting process diagrams shown in FIGS. 3 to 5. "S+number" of a left column of FIGS. 3 to 5 indicates a number of a knitting process, and a formed state of the stitches in the FB and the BB is shown in a right column. The portion where knitting is actually carried out in each process is shown with a thick line. Upper case alphabets in the drawings indicate the positions of knitting needles. The stitches of a base knitted fabric portion 1F are indicated with a diamond shaped mark, the stitches of a base knitted fabric portion 1B are indicated with a pentagon shaped mark, and the stitches knitted with a decoration knitting yarn Y8 different from a base knitting yarn Y7 for knitting the base knitted fabric portions 1F, 1B are indicated with a circular mark. The double mark indicates a double stitch.

In S0, a state in which the stitches of the base knitted fabric portion 1F are held on the knitting needles B to P of the FB, and the stitches of the base knitted fabric portion 1B are held on the knitting needles B to P of the BB is shown. The base knitted fabric portions 1F, 1B are knitted with the base knitting yarn Y7. Wool yarn, elastic yarn, thermally fusible yarn, or the like can be used for the base knitting yarn Y7. When forming the decoration pattern 111 in the shoe upper, the base knitting yarn Y7 is preferably a thermally fusible yarn. An empty needle is not formed within a knitting width of the base knitted fabric portions 1F, 1B and the base knitted fabric portions 1F, 1B including closely formed stitches are obtained. The knitting of the decoration unit 111 (see FIGS. 1 and 2) is carried out from such state.

In S1, a part of the base knitted fabric portions 1F, 1B is moved in the knitting width direction, and an empty needle is formed within the knitting width of the base knitted fabric portions 1F, 1B. The empty needle formed in the BB (FB) is provided to temporarily move the stitches of the base knitted fabric portion 1F (1B) when forming the decoration unit 2 in the base knitted fabric portion 1F (1B) (see next S2 for operation of temporarily moving the base knitted fabric portion 1F). The position of forming the empty needle is preferably selected such that the moving distance of the stitch becomes small when temporarily moving the base knitted fabric portion 1F (1B) to the BB (FB). In the present example, the stitches held on the knitting needles E, G, K, M of the FB and the knitting needles E, G, K, M of the BB are overlapped with the stitches on the immediate left of the plane of drawing so that the knitting needles E, G, K, M become the empty needles. The double stitches formed in S1 are indicated with a single mark instead of a double mark after S2.

In S2, the stitches of the base knitted fabric portion 1F held on the knitting needles B, F, H, L, N of the FB are transferred to the knitting needles A, E, G, K, M of the BB. According to such transfer, the stitches of the base knitted fabric portion 1F remain on the knitting needles C, D, I, J, O, P of the FB (corresponding to process α). Some of the stitches remaining on the FB are a left side starting stitch 11 that becomes a starting point for forming the left edge 2L of the decoration unit 2 and a right side starting stitch 19 that becomes a starting point for forming the right edge 2R of the decoration unit 2 shown in a circled enlarged view of FIG. 1. This is specifically described as below.

- The stitch of the knitting needle D of the FB is the left side starting stitch 11 for forming the left edge 2L of the decoration unit 2 on the left side.
- The stitch of the knitting needle J of the FB is the right side starting stitch 19 for forming the right edge 2R of the decoration unit 2 on the left side, and the left side starting stitch 11 for forming the left edge 2L of the decoration unit 2 on the right side.
- The stitch of the knitting needle P of the FB is the right side starting stitch 19 for forming the right edge 2R of the decoration unit 2 on the right side.

In S3, the decoration knitting yarn Y8, which is a knitting yarn different from the base knitting yarn Y7, is fed from the yarn feeder 8 to form a pickup stitch 25 on the knitting needles B, F, H, L, N of the FB, and form a stitch following the starting stitches 11, 19 of the knitting needles D, J, P of the FB (corresponding to process β). The stitch formed on the knitting needle D of the FB is a left edge stitch 21 that becomes the left edge 2L of the decoration unit 2 on the left side. The stitch formed on the knitting needle J of the FB is a right edge stitch 29 that becomes the right edge 2R of the decoration unit 2 on the left side, and is also the left edge stitch 21 that becomes the left edge 2L of the decoration unit 2 on the right side. The stitch formed on the knitting needle P of the FB is the right edge stitch 29 that becomes the right edge 2R of the decoration unit 2 on the right side. The decoration knitting yarn Y8 is a knitting yarn that differs from the base knitting yarn Y7 in material, texture, thickness, or color. In particular, the decoration unit 2 can be formed to stand out by differing the color of the decoration knitting yarn Y8 from the color of the base knitting yarn Y7.

Either the left edge stitch 21 or the right edge stitch 29 may be formed first. Which stitch 21, 29 to be formed first depends on the moving direction of the yarn feeder 8. Furthermore, the position of forming the pickup stitch 25 is not particularly limited. In the case of the present example, the pickup stitch 25 is formed on the FB since the empty needle is not provided on the BB, but the pickup stitch 25 may be formed on an upper back needle bed when, for example, the four-bed flat knitting machine is used. As the pickup stitch 25 is removed from the needle bed in the next S4, the pickup stitch may be formed on the knitting needle of any needle bed.

In S4, the pickup stitch 25 formed in S3 is removed from the FB (corresponding to process γ). As a result, the lower edge 2D configured with the decoration knitting yarn Y8 that traverses the front side of the stitches of the base knitted fabric portion 1F (stitches of the knitting needles A, E, G, K, M of the BB) transferred to the BB in S2 is formed. Since the yarn length between the left edge stitch 21 and the right edge stitch 29 becomes long by the amount of the pickup stitch 25 removed from the FB, the stitches 21, 29 can be enlarged. In S4, in addition to removing the pickup stitch 25 from the FB, the knitting needles D, J, P of the FB on which the left edge stitch 11 and the right edge stitch 19 are held may be withdrawn from a needle gap to enlarge the left edge stitch 21 and the right edge stitch 29.

In S5, the stitches of the base knitted fabric portion 1F temporarily moved to the knitting needles A, E, G, K, M of the BB in S2 are returned to the knitting needles B, F, H, L, N of the FB. After S5, the knitting similar to S2 to S5 is also carried out with respect to the base knitted fabric portion 1B. The held state of the stitches when the knitting with respect to the base knitted fabric portion 1B is completed and the arrangement state of the decoration knitting yarn Y8 are shown in S6.

In S7 of FIG. 4, the arrangement of the stitches in the FB is changed. Specifically, the stitches of the base knitted fabric portion 1F held on the knitting needles C, I, O of the FB are transferred to the knitting needles D, J, P of the FB, and the left edge stitch 21 and the right edge stitch 29 held on the knitting needles D, J, P of the FB are transferred to the knitting needles E, K, Q of the FB. The arrangement of the stitches is changed here to make the interval of each stitch of the base knitted fabric portion 1F equal, so that the size of each stitch of the base knitted fabric portion 1F is made the same when knitting the base knitted fabric portion 1F in the next S8.

In S8, the yarn feeder 7 is moved in one direction to form a new stitch on the stitches held on the knitting needles B, D, F, H, J, L, N, P of the FB, and form the pickup stitch on the knitting needles E, G, K, M of the BB (corresponding to process $\delta_1$). According to S8, the base knitted fabric portion 1F is branched to a base front part 10F knitted with the FB and a base back part 10B knitted with the BB.

In S9, a new stitch is knitted on the stitch of the base back part 10B held on the BB, and in S10, a new stitch is knitted on the stitch of the base front part 10F held on the FB. S9 and S10 are repeated as necessary (corresponding to process $\delta_2$). The lengths of the left edge 2L and the right edge 2R of the decoration unit 2 are determined by the number of repetitions. A tube shape in which the cross-section of the portion where the decoration unit 2 is formed in the base knitted fabric portion 1F is a substantially circular shape is obtained by repeating S9 and S10 by the same number of times. A tube shape in which the cross-section is a substantially D-shape is obtained by making the number of times to carry out S10 greater than the number of times to carry out S9 or by repeating only S10 without carrying out S9. In such a case, a side to be touched by the wearer of the base knitted fabric portion 1 can be formed to a flat shape.

When the base knitted fabric portion 1B is formed to a tube shape, similar to the base knitted fabric portion 1F, a hole at an end of the base knitted fabric portion 1F and a hole at an end of the base knitted fabric portion 1B may be connected. When connecting the holes, the pickup stitch may be formed on the outer side of the knitting width of the base knitted fabric portion 1F when increasing the knitting course of the base knitted fabric portion 1F, and the pickup stitch may be interweaved in the base knitted fabric portion 1B when knitting the base knitted fabric portion 1B.

In S11, the base back part 10B held on the knitting needles E, G, K, M of the BB is overlapped with the base front part 10F held on the knitting needles D, F, J, L of the FB. S11 is a process carried out to connect the base front part 10F and the base back part 10B, but the parts 10F, 10B are not yet connected at this point of time.

After S11, knitting similar to S8 to S11 is also carried out with respect to the base knitted fabric portion 1B. The held state of the stitches when the knitting with respect to the base knitted fabric portion 1B is completed is shown in S12.

In S13 of FIG. 5, the base knitted fabric portions 1F, 1B are knitted for one course (corresponding to process $\delta_3$). According to S13, the base front part 10F and the base back part 10B of the base knitted fabric portion 1F (1B) are connected.

In S14, the stitches of the base knitted fabric portion 1F held on the knitting needles B, D, H, J, N, P of the FB are transferred to the knitting needles C, E, I, K, O, Q of the BB. According to such transfer, the stitches of the base knitted fabric portion 1F remain on the knitting needles F, L of the FB (process ζ). The stitch of the knitting needle F of the FB is a left fixing stitch 13 for fixing the left end of the upper edge 2U in the decoration unit 2 on the left side shown in a circled enlarged view of FIG. 1. The stitch of the stitch L of the FB is a right fixing stitch 17 for fixing a right end of the upper edge 2U in the decoration unit 2 on the left side, and is also the left fixing stitch 13 for fixing the left end of the upper edge 2U in the decoration unit 2 on the right side. For the sake of convenience of the plane of drawing, the right fixing stitch 17 for the decoration unit 2 on the right side is not shown in S15.

In S15, the yarn feeder 8 is moved in one direction to carry out tuck on the stitches 13, 17 of the knitting needles F, L of the FB, and to carry out miss on other portions (corresponding to process η). As a result, the upper edge 2U configured with the decoration knitting yarn Y8 that traverses the front side of the stitches of the base knitted fabric portion 1F (stitches of the knitting needles C, E, I, K, O, Q of the BB) transferred to the BB in S14 is formed.

In S16, the stitches of the base knitted fabric portion 1F temporarily moved to the knitting needles C, E, I, K, O, Q of the BB in S14 are returned to the knitting needles B, D, H, J, N, P of the FB. After S16, knitting similar to S14 to S16 is also carried out with respect to the base knitted fabric portion 1B. The held state of the stitches when the knitting with respect to the base knitted fabric portion 1B is completed and the arrangement state of the decoration knitting yarn Y8 are shown in S17.

In S18, a new stitch following a wale direction of the stitches of the base knitted fabric portions 1F, 1B, the left edge stitch 21, and the right edge stitch 29 are knitted and a twisted stitch shown with an outlined arrow is knitted on the empty needle (corresponding to process ε). According to S18, the left edge stitch 21 and the right edge stitch 29 are connected to the base knitted fabric portions 1F, 1B, and the left edge 2L and the right edge 2R of the decoration unit 2 are formed. The twisted stitch formed in S18 is provided to return the number of stitches lined in the knitting width direction reduced in S1 of FIG. 3 back to the original number.

According to the knitting process described above, the decoration pattern 111 shown in FIG. 1 can be formed in the shoe upper 100 in a seamless manner. The knitted fabric including such decoration pattern 111 is a novel knitted fabric which has not existed before.

Second Embodiment

Figure 6:
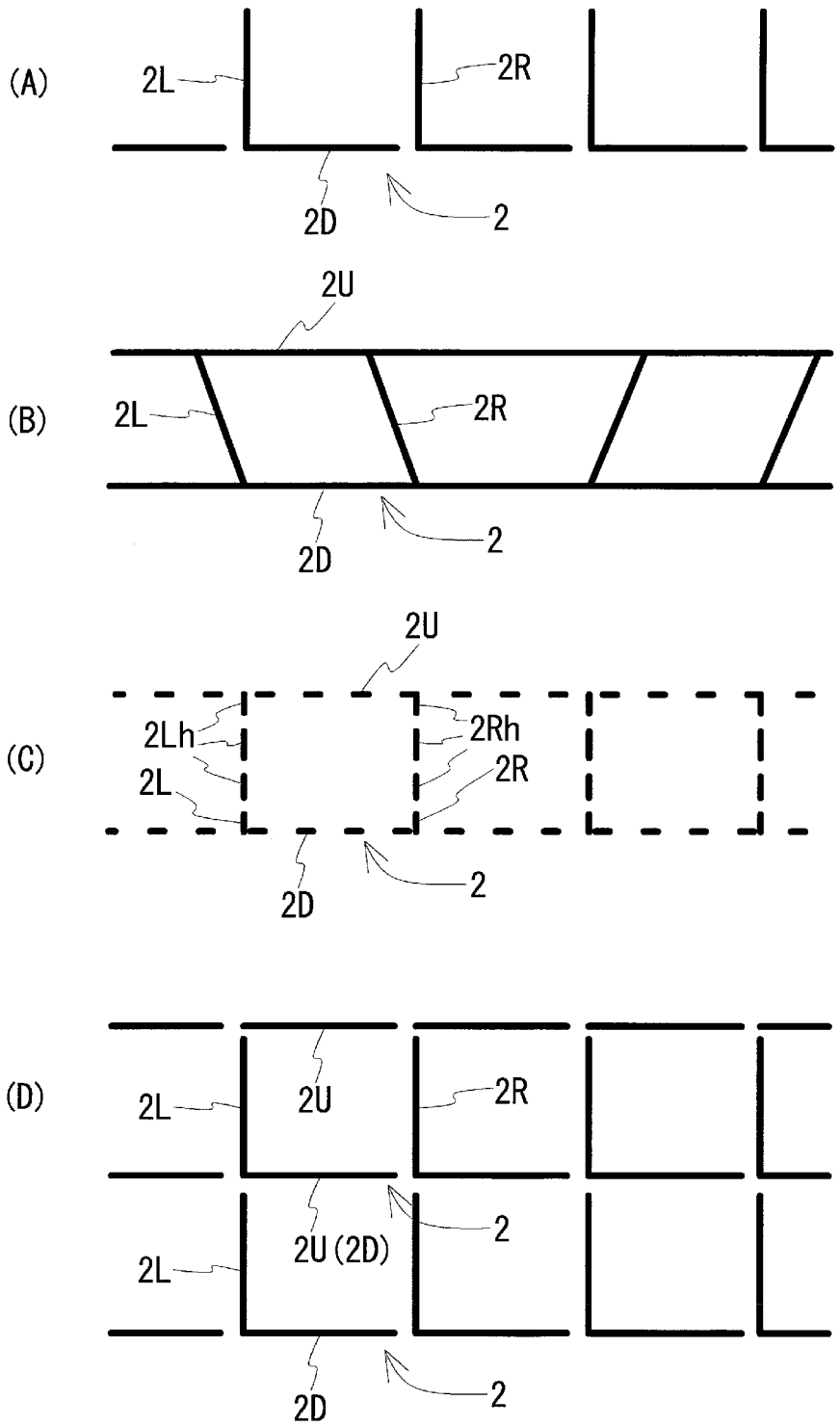
FIGS. 6A to 6D are schematic views showing an example of a decoration unit knitted by applying the method for knitting the knitted fabric of the first embodiment.

A variety of decoration units 2 can be knitted by applying the method for knitting the knitted fabric described in the first embodiment. One example of such decoration unit is illustrated in FIGS. 6A to 6D. In FIG. 6, the left edge 2L and the right edge 2R configured by stitches are shown with a thick line for the sake of convenience of explanation.

FIG. 6A shows the decoration unit 2 configured by the lower edge 2D, the left edge 2L, and the right edge 2R. When knitting such decoration unit 2, the knitting of S1 of FIG. 3 to S13 of FIG. 5 is carried out, and thereafter, the knitting corresponding to S18 is carried out without carrying out the knitting corresponding to S14 to S16 with respect to the base knitted fabric portions 1F, 1B.

FIG. 6B shows the decoration unit 2 in which the left edge 2L and the right edge 2R are inclined. When knitting such decoration unit 2, the knitting corresponding to S18 is carried out after moving the left edge stitch 21 and the right edge stitch 29 to different positions in the knitting width direction after S17 of FIG. 5. In FIG. 6B, the lower edge 2D and the right edge 2R are connected, but this can be achieved by leaving only the starting stitches 11, 19 on the FB in S2 of FIG. 3.

FIG. 6C shows the decoration unit 2 formed to a dotted line form. When knitting such decoration unit 2, the lower edge 2D of a dotted line form and the short left edge 2L and right edge 2R are first knitted. In S2 of FIG. 3, the lower edge 2D can be knitted by allocating a plurality of stitches between the left side starting stitch 11 and the right side starting stitch 19 to the FB and the BB, in S2 of FIG. 3.

After fixing the left edge 2L and the right edge 2R to the base knitted fabric portion, the base knitted fabric portion and an auxiliary edge 2Lh (auxiliary when forming the base knitted fabric portion 1B to a tube shape 2Rh) following the left edge 2L (right edge 2R) is knitted. The auxiliary edges 2Lh, 2Rh can be formed by knitting stitches in the base knitted fabric portion with the decoration knitting yarn. The upper edge 2U can be knitted by allocating a plurality of stitches between the left fixing stitch 13 and the right fixing stitch 17 to the FB and the BB, in S14 of FIG. 5.

FIG. 6D shows the decoration unit 2 continuing in the wale direction of the base knitted fabric portion. In this example, the lower edge 2D of the decoration unit 2 on the upper course also serves as the upper edge 2U of the decoration unit 2 on the lower course. In such a case, the lower edge 2D, the left edge 2L, and the right edge 2R of the decoration unit 2 on the upper course are knitted after the lower edge 2D, the left edge 2L, and the right edge 2R of the decoration unit 2 on the lower course are knitted. The upper edge 2U of the decoration unit 2 on the upper course is obtained through the knitting similar to the knitting of S14 to S16 of FIG. 5. Such knitting can also be carried out while shifting the decoration unit 2 on the lower course and the decoration unit 2 on the upper course. Accordingly, a decoration of a brick wall like pattern can be formed.

Although not shown, the decoration unit in which the lower edge, the left edge, and the right edge form a triangular shape can be formed. In such a case, the left edge stitch 21 and the right edge stitch 29 are overlapped when carrying out S18 of FIG. 5.

A plurality of decoration units can be formed at positions spaced apart in the knitting width direction. The decoration unit on the left side and the decoration unit on the right side can be knitted continuously all at once. For example, when moving the yarn feeder for feeding the decoration knitting yarn toward the right side, the left edge stitch, the cross-over yarn of the lower edge, and the right edge stitch of the decoration unit on the left side are formed, and thereafter, the decoration knitting yarn is passed to the back side of the base knitted fabric portion, and then the left edge stitch, the cross-over yarn of the lower edge, and the right edge stitch of the decoration unit on the right side are formed.

<Others>

The decoration unit 2 described in the first and second embodiments can also be applied to a knitted fabric other than the shoe upper 100. For example, the decoration unit 2 can be applied to knitwear, knit pants, small knitted articles such as a handkerchief, and furthermore, a knitted cover, and the like, thus enhancing the designability thereof. The base knitted fabric portion 1 forming the decoration unit 2 is a plain stitch pattern in the first and second embodiments, but may be other knitting patterns such as a rib pattern.

DESCRIPTION OF REFERENCE NUMERALS

FB front needle bed
BB back needle bed
100 shoe upper (knitted fabric)
100*s* set up section
110 instep cover
111 decoration pattern
112 instep portion
113 side portion
120 sole cover
1, 1F, 1B base knitted fabric portion
10F base front part
10B base back part
11 left side starting stitch
19 right side starting stitch
13 left fixing stitch
17 right fixing stitch
2 decoration unit
2D lower edge
2U upper edge
2L left edge
2R right edge
21 left edge stitch
29 right edge stitch
25 pickup stitch
2Lh, 2Rh auxiliary edge
7, 8 yarn feeder
Y7 base knitting yarn
Y8 decoration knitting yarn

The invention claimed is:

1. A method for knitting a knitted fabric in which a base knitted fabric portion is knitted and a decoration knitting yarn different from a base knitting yarn for knitting the base knitted fabric portion is interweaved in the base knitted fabric portion, using a flat knitting machine including one needle bed and other needle bed disposed opposite to each other in a front-back direction, and a plurality of yarn feeders that feed a knitting yarn to knitting needles of the needle beds, the method comprising process α to process ε by which a decoration unit is formed on a front surface of the base knitted fabric portion, the decoration unit being configured by a lower edge extending in a knitting width direction of the base knitted fabric portion, a left edge extending in a direction intersecting the knitting width direction from a left end of the lower edge, and a right edge extending in a direction intersecting the knitting width direction from a right end of the lower edge, the process α of transferring some stitches of the base knitted fabric portion held on the one needle bed to the other needle bed and leaving at least a left side starting stitch, which is a starting point for forming the left edge, and a right side starting stitch, which is a starting point for forming the right edge, on the one needle bed as a preparation for forming the lower edge, the process β of using the decoration knitting yarn to knit a left edge stitch continuing in a wale direction of the left side starting stitch and a right edge stitch continuing in a wale direction of the right side starting stitch, and form a pickup stitch on an empty needle between the left edge stitch and the right edge stitch, the process γ of removing the pickup stitch from the knitting needle, and forming the lower edge configured by the decoration knitting yarn traversing a front side of the stitches transferred to the other needle bed in the process α between the left edge stitch and the right edge stitch, the process δ of increasing number of knitting courses of the base knitted fabric portion with the left edge stitch and the right edge stitch remained held on the one needle bed, and the process ε of overlapping and fixing the left edge stitch and the right edge stitch with the stitches of the base knitted fabric portion, and forming the left edge configured by the left edge stitch and the right edge configured by the right edge stitch.

2. The method for knitting the knitted fabric according to claim 1, wherein in the process α, a plurality of the left side starting stitches and a plurality of the right side starting stitches are remained on the one needle bed.

3. The method for knitting the knitted fabric according to claim 1, comprising processes ζ, η by which an upper edge connecting an upper end of the left edge and an upper end of the right edge is formed, the process ζ of transferring some stitches of the base knitted fabric portion held on the one needle bed to the other needle bed and leaving at least a left fixing stitch for fixing a left end of the upper edge and a right fixing stitch for fixing a right end of the upper edge on the one needle bed as a preparation for forming the upper edge after the process ε, and the process η of using the decoration knitting yarn to carry out tuck on the left fixing stitch and the right fixing stitch and carry out miss between the fixing stitches, and forming the upper edge traversing a front side of the stitches transferred to the other needle bed in the process ζ between the fixing stitches.

4. The method for knitting the knitted fabric according to claim 1, wherein in the process δ, processes $\delta_1$ to $\delta_3$ are carried out to form the base knitted fabric portion to a tube shape, the process $\delta_1$ of branching the base knitted fabric portion to a base front part knitted with the one needle bed and a base back part knitted with the other needle bed, the process $\delta_2$ of increasing number of courses of at least the base front part, and the process $\delta_3$ of connecting the base front part and the base back part by knitting.

5. The method for knitting the knitted fabric according to claim 1, wherein when the base knitted fabric portion is held on the one needle bed and the other needle bed, and the decoration unit is knitted from a state an empty needle is not provided within a knitting width of the base knitted fabric portion, an empty needle is formed within the knitting width of the base knitted fabric portion by transfer before the process α.

6. The method for knitting the knitted fabric according to claim 2, comprising processes ζ, η by which an upper edge connecting an upper end of the left edge and an upper end of the right edge is formed, the process ζ of transferring some stitches of the base knitted fabric portion held on the one needle bed to the other needle bed and leaving at least a left fixing stitch for fixing a left end of the upper edge and a right fixing stitch for fixing a right end of the upper edge on the one needle bed as a preparation for forming the upper edge after the process ε, and the process η of using the decoration knitting yarn to carry out tuck on the left fixing stitch and the right fixing stitch and carry out miss between the fixing stitches, and forming the upper edge traversing a front side of the stitches transferred to the other needle bed in the process ζ between the fixing stitches.

7. The method for knitting the knitted fabric according to claim 2, wherein in the process δ, processes $\delta_1$ to $\delta_3$ are carried out to form the base knitted fabric portion to a tube shape, the process $\delta_1$ of branching the base knitted fabric portion to a base front part knitted with the one needle bed and a base back part knitted with the other needle bed, the process $\delta_2$ of increasing number of courses of at least the base front part, and the process $\delta_3$ of connecting the base front part and the base back part by knitting.

8. The method for knitting the knitted fabric according to claim 6, wherein in the process δ, processes $\delta_1$ to $\delta_3$ are carried out to form the base knitted fabric portion to a tube shape, the process $\delta_1$ of branching the base knitted fabric portion to a base front part knitted with the one needle bed and a base back part knitted with the other needle bed, the process $\delta_2$ of increasing number of courses of at least the base front part, and the process $\delta_3$ of connecting the base front part and the base back part by knitting.

9. The method for knitting the knitted fabric according to claim 2, wherein when the base knitted fabric portion is held on the one needle bed and the other needle bed, and the decoration unit is knitted from a state an empty needle is not provided within a knitting width of the base knitted fabric portion, an empty needle is formed within the knitting width of the base knitted fabric portion by transfer before the process α.

* * * * *